US007487847B2

(12) United States Patent
Latos et al.

(10) Patent No.: US 7,487,847 B2
(45) Date of Patent: Feb. 10, 2009

(54) LATERAL DOWNHOLE DRILLING TOOL

(75) Inventors: Gordon Latos, Calgary (CA); John Person, Calgary (CA)

(73) Assignee: Emerald Bay Energy, Inc., Calgary (CA)

( * ) Notice: Subject to any disclaimer, the term of this patent is extended or adjusted under 35 U.S.C. 154(b) by 162 days.

(21) Appl. No.: 11/198,094

(22) Filed: Aug. 5, 2005

(65) Prior Publication Data

US 2006/0032672 A1 Feb. 16, 2006

Related U.S. Application Data

(60) Provisional application No. 60/599,052, filed on Aug. 6, 2004.

(51) Int. Cl.
*E21B 7/08* (2006.01)

(52) U.S. Cl. ..... 175/61; 175/79; 166/117.5

(58) Field of Classification Search ..... 175/61, 175/60, 77, 79, 80, 82; 166/50, 117.5
See application file for complete search history.

(56) References Cited

U.S. PATENT DOCUMENTS 2,345,816 A * 4/1944 Hays ..... 175/82
2,558,227 A * 6/1951 Yancey et al. ..... 175/78
3,838,736 A 10/1974 Driver
4,007,797 A * 2/1977 Jeter ..... 175/26
4,051,908 A 10/1977 Driver
4,527,639 A * 7/1985 Dickinson et al. ..... 175/61
5,052,404 A * 10/1991 Hodgson ..... 600/585
5,439,066 A * 8/1995 Gipson ..... 175/61
6,220,372 B1 * 4/2001 Cherry ..... 175/81
6,283,230 B1 * 9/2001 Peters ..... 175/67

* cited by examiner

*Primary Examiner*—Jennifer H Gay
*Assistant Examiner*—Daniel P Stephenson
(74) *Attorney, Agent, or Firm*—Nixon Peabody LLP

(57) ABSTRACT

A flexible lateral drilling shaft is disclosed, having a concentrically nested arrangement of two or more coil springs of which the winding direction of at least one of the springs is opposite to another of the springs. The shaft is included within a lateral drilling tool which includes a deflection assembly having roller bearings to assist the deflection of the flexible shaft. Once inserted into a wellbore, increasing pressure applied to the shaft will cause the opposing springs to stiffen against each other, providing sufficient strength to support the drilling of a lateral drainhole within the wellbore. Further, the spring is wound from a steel wire having a specific noncircular profile to improve the strength characteristics of the shaft without increasing the bending stress during deflection.

15 Claims, 11 Drawing Sheets

Outer Spring #1

Inner Spring #1

LATERAL DOWNHOLE DRILLING TOOL

CROSS REFERENCE TO RELATED APPLICATIONS

This application claims the benefit of U.S. Provisional Application No. 60/599,052, filed Aug. 6, 2004 which is incorporated by reference herein in its entirety.

FIELD OF THE INVENTION

The present invention relates generally to downhole drilling tools. More particularly, the present invention relates to a flexible drilling apparatus and deflection assembly for drilling lateral or sloping drain holes from a wellbore.

BACKGROUND OF THE INVENTION

During production from a cased wellbore, it is often desired to drill lateral drainholes through the casing or open surface of the well to permit further communication between the wellbore and the formation. In the past, such drainholes have been created by lowering a flexible drill shaft and drill bit into the well. The flexible drill shaft is mounted within an elbowed portion which deflects the flexible drill shaft and drill bit to a given (usually 90 degree) angle with respect to the wellbore. The drill shaft must be flexible to accommodate the desired bend, while maintaining sufficient stiffness to enable the flexible shaft to effectively drill the lateral drainhole.

One means for providing flexibility to the shaft is to incorporate a spring within the flexible drill shaft; however, such attempts have been unsuccessful from a practical perspective. For example, U.S. Pat. Nos. 3,838,736 and 4,051,908 to Driver describe flexible drill shafts in which a coil spring is included within the shaft, permitting redirection of the drill as deflected by an elbowed tubing string. In general, such systems are limited in utility with respect to the amount of torque that can be applied to the drill and are highly susceptible to spring failure.

Further, U.S. Pat. No. 6,220,372 to Cherry describes an apparatus for drilling lateral drainholes using a deflection assembly and a dual-spring flexible drill shaft. The deflection assembly includes an elbow and three bearings at the 0.45, and 90 degree positions within the assembly to reduce frictional wear within the system. The deflection assembly is attached to the tubing string and is lowered into the wellbore to a desired height, and the dual spring flexible shaft is then inserted within the tubing string and is deflected by the deflection assembly through a 90 degree angle. The drill shaft includes two counter-coiled springs telescopically engaged with one another such that the application of torque to the springs will tighten the outer spring and expand the inner spring, thereby stiffening the shaft due to the counteracting radial forces between the springs. This type of shaft, although an improvement over the single spring shaft, remains prone to bending stress, metal fatigue, and friction between adjacent coils of each spring, providing limited ability to effectively penetrate either well casing or wellbore. Moreover, advancement of the shaft through a deflection assembly causes the springs to stiffen prematurely, reducing the flexibility of the shaft during deflection.

It is, therefore, desirable to provide an improved drilling system for use in drilling lateral drainholes within a wellbore.

SUMMARY OF THE INVENTION

In accordance with a first embodiment of the invention, there is provided a drilling shaft comprising two counter-coiled wire springs, each spring having a noncircular cross sectional profile. Preferably, the drilling shaft includes two counter-coiled wire springs telescopically and slidingly engaged with respect to each other and wherein the tolerance between the outer diameter of the inner spring and the inner diameter of the outer spring is 0.0 to 0.01". It is also preferred that the cross-section of each spring is generally rectangular with fillets on the corners.

In accordance with a second embodiment, there is provided a lateral drainhole drilling tool for deflecting a flexible shaft through an angle of deflection, the tool comprising a deflection assembly operatively retaining at least one roller bearing.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a deflection apparatus for use in the drilling of a lateral or sloping drainhole within a wellbore. More specifically, the invention provides an assembly 1 including a flexible drill shaft 10, a drill bit 20, and an elbowed deflection assembly 30 for deflecting the flexible shaft 10 through an angle (preferably 45-90 degrees) to drill a lateral or sloping drainhole within a wellbore.

Figure 1:
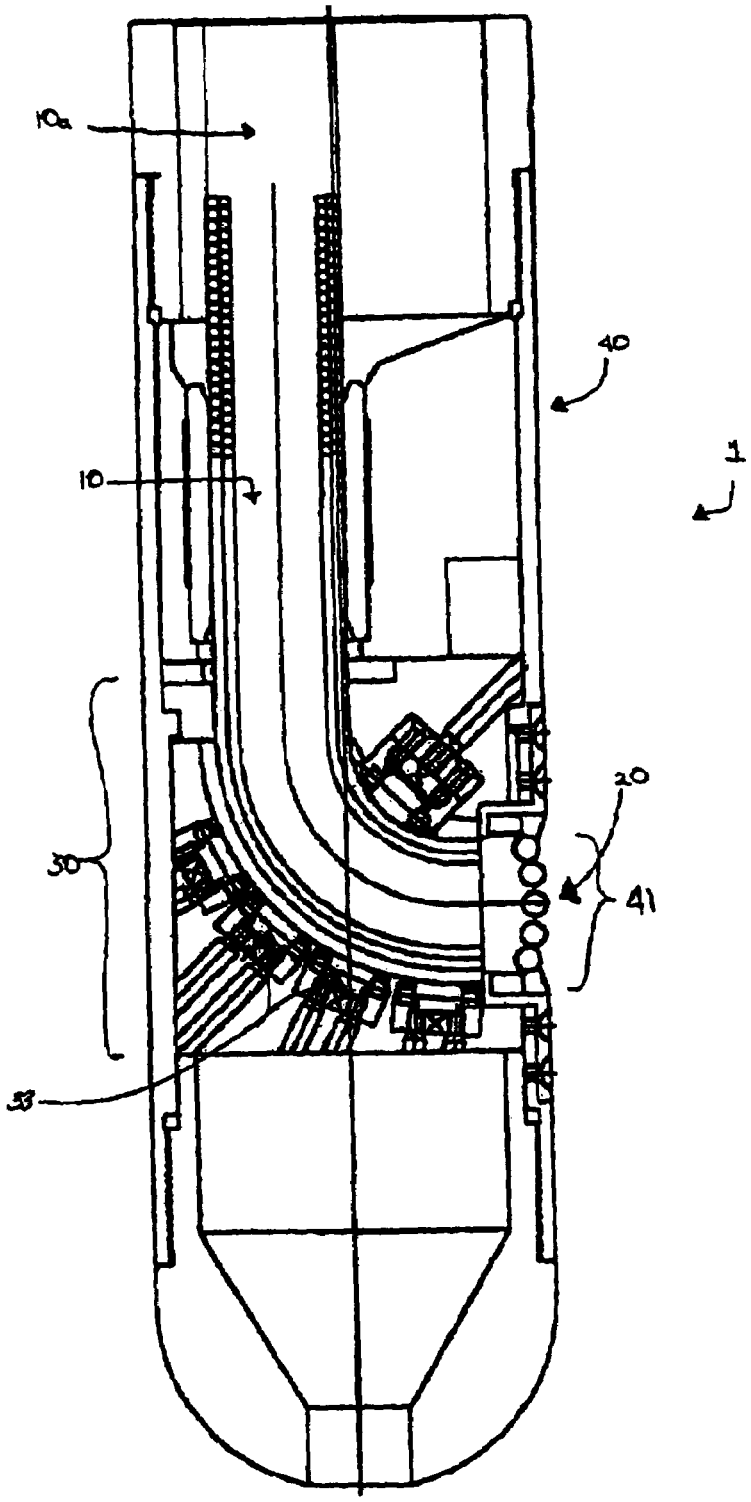
FIG. 1 is a longitudinal cross sectional view of a drive assembly in accordance with an embodiment of the invention.

The assembly 1, as shown in FIG. 1, supports a flexible shaft 10 that is attached to a drive shaft 10*a* and rotated by a motor (not shown) which rotates the shafts 10, 10*a* about an axis parallel to the longitudinal axis of the wellbore. The torque of the motor is transmitted to the drill bit 20 via the flexible shaft 10.

In operation, the assembly 1 is lowered into and anchored at a specific downhole location with the flexible shaft and drill bit in a deflected and non-extended position. After anchoring and upon rotation of the drive shaft and application of a downhole pressure, the flexible shaft and drill bit extend outwardly to drill a lateral hole through well casing (if present) and into the formation.

The deflection assembly 30 is designed to deflect the flexible shaft 10 through an angle (most preferably 90 degrees) whilst allowing torque and force to be applied to the drill bit 20, while minimizing the friction and cyclical stress placed on the shaft 10 during rotation by the motor. Control of these parameters significantly influences net bit torque and net weight on the bit 20, facilitating controlled drilling of lateral drainholes within the wellbore.

Drive Assembly

Figure 2:
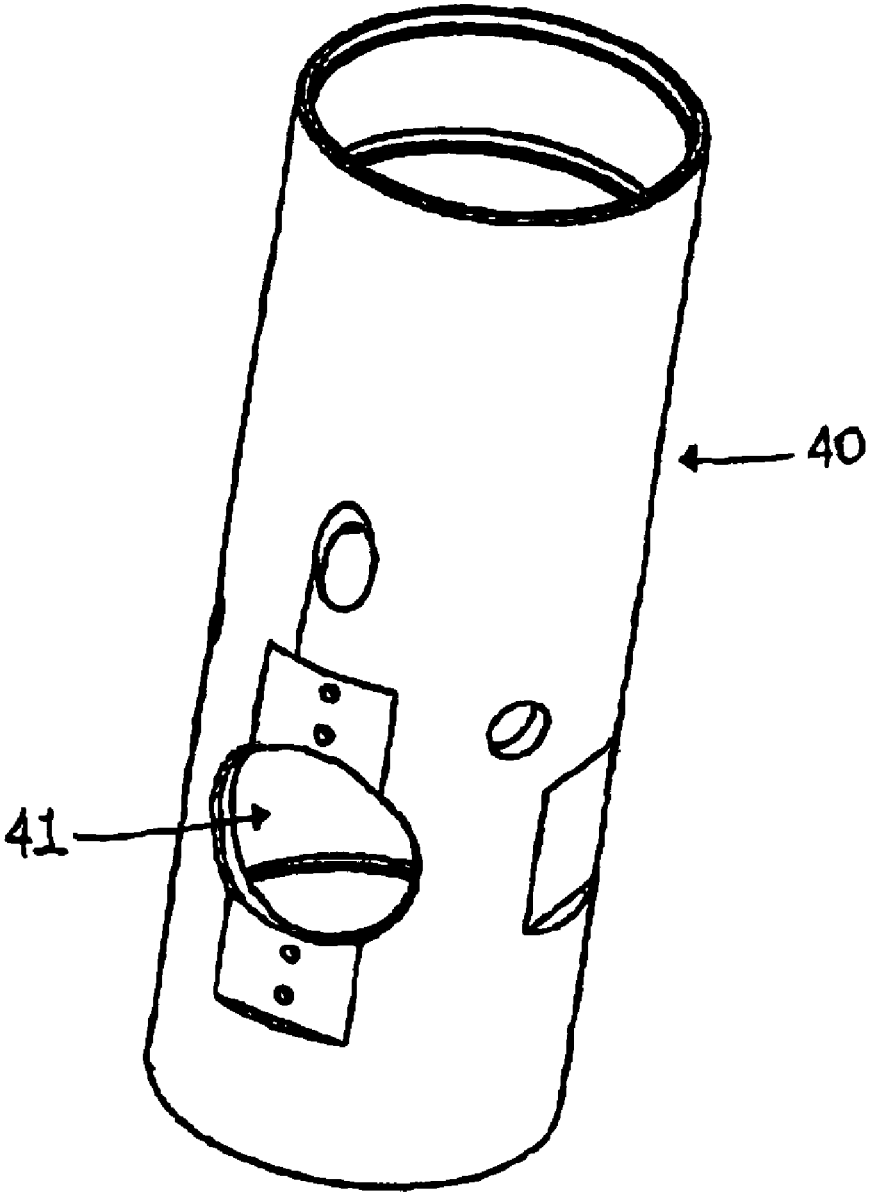
FIG. 2 is a perspective view of a housing in accordance with an embodiment of the invention.

The assembly 1 includes an adjustable housing 40, as shown in FIG. 2, for containing the flexible shaft 10 and deflection assembly 30. In operation, the housing 40 is connected to the surface through appropriate connection systems. The housing 40 includes a drilling aperture 41, and also provides an internal path for casing and formation cuttings to clear the lateral drainhole, passing through to the wellbore below the drill bit 20.

Figure 3:
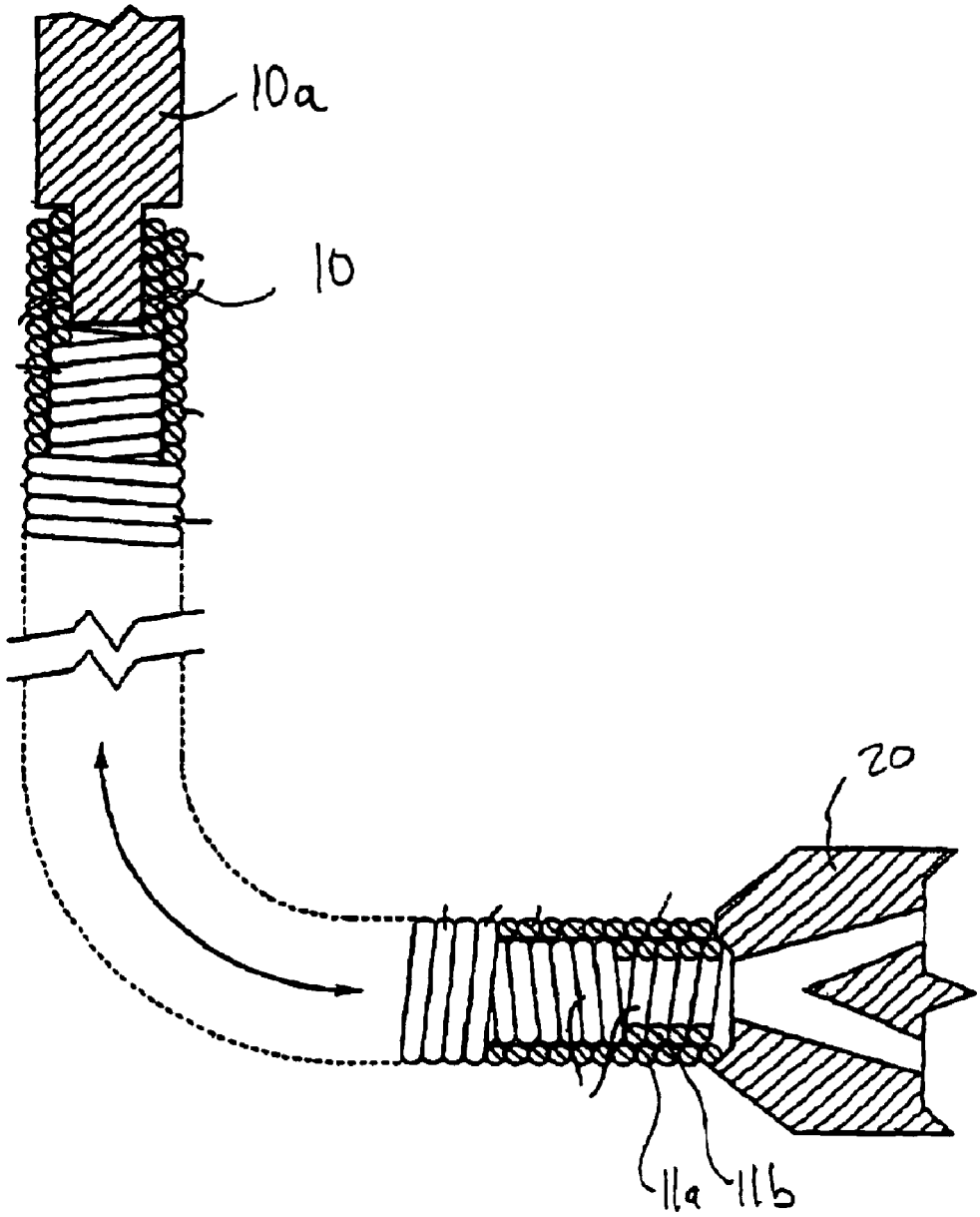
Figure 3 Prior Art
FIG. 3 is a cutaway view of a flexible drilling shaft in accordance with the prior art.
Figure 4:
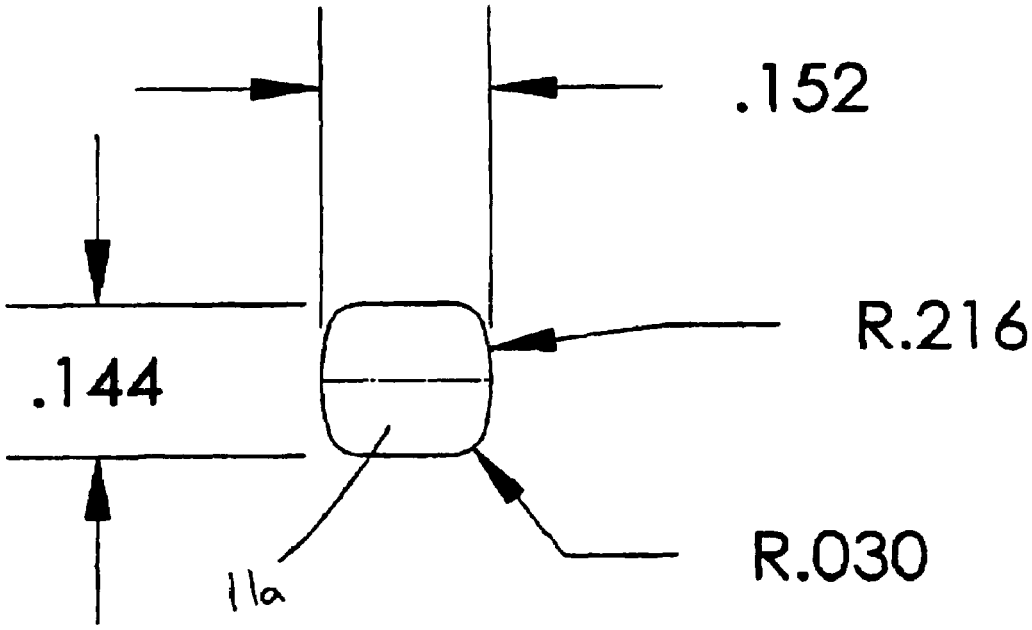
FIG. 4 is a cross sectional view of the metal wire profile for the outer spring, in accordance with one embodiment of the invention.
Figure 5:
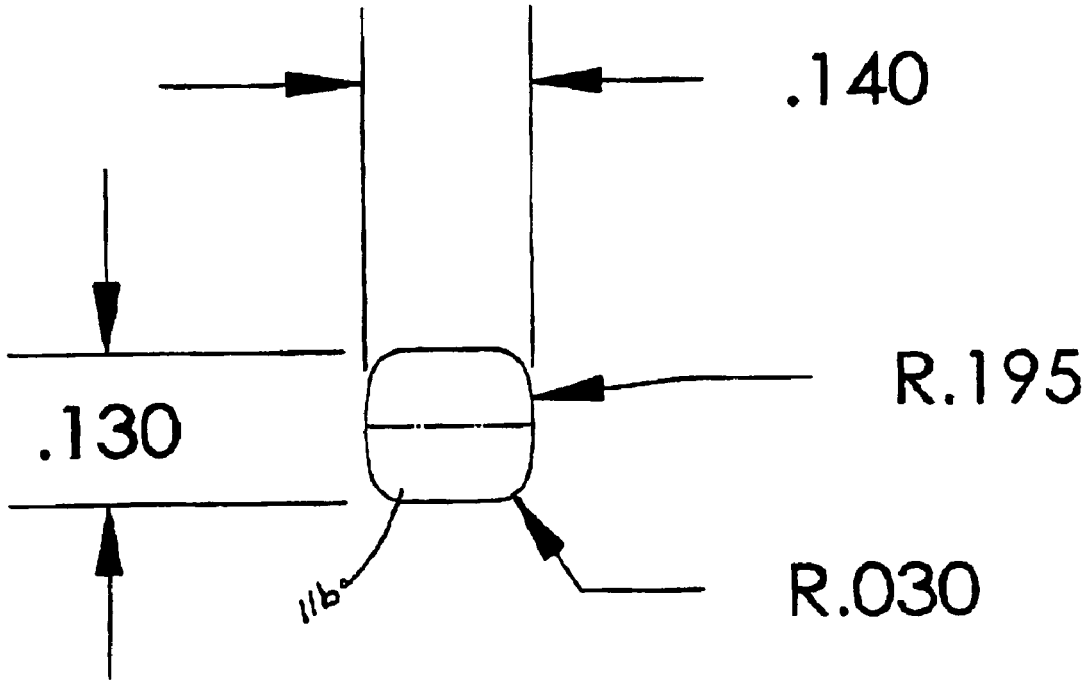
FIG. 5 is a cross sectional view of the metal wire profile for the inner spring, in accordance with one embodiment of the invention.

Various embodiments of the flexible shaft 10 are possible. In a preferred embodiment, the flexible shaft is a dual-coiled spring as shown in accordance with the prior art shown in FIG. 3, but with the dual-coiled springs having non-circular cross-sections as shown in FIGS. 4-5 that enable deflection of the shaft 10 through 90 degrees to a position generally perpendicular to the axis of the tool. More specifically, the shaft 10 is preferably a concentrically nested arrangement of two or more coil springs 11*a*, 11*b* of which the winding direction of each of the springs 11*a*, 11*b* is opposite to another (ie counter-coiled) in radially adjacent springs 11. As a result and with such a configuration, when torque is applied to the shaft 10 in one direction, for example through clockwise rotation of the shaft and with a righthanded outer spring, the outer spring 11*a* will inwardly tighten against the corresponding lefthanded inner spring 11*b*, that is being outwardly tightened against the outer spring 11*a*. This radial displacement of the inner and outer springs against each other results in a stiffening of the shaft 10 to support the driving of the drill bit 20 through the well casing and formation in a substantially straight line.

During drilling, drilling fluids are circulated through the shaft and drill bit 20, to minimize the build-up of drilling debris around the deflection assembly 30.

Coil Spring Design

Coil springs, in general, are prone to bending stress, metal fatigue, and friction between adjacent coils of each spring, particularly when used repeatedly under high stress conditions. The springs 11 of the present invention have been designed to maximize the useful service life of the flexible shaft 10 by minimizing the cyclical stress which the springs 11 are subjected to while rotating within the deflection assembly 30. Representative values of desired bend radius, outer coil diameter, outer coil wire diameter, inner coil wire diameter, wire corner fillet and inner and outer coil side curvature are shown in Table 1. With respect to these values it is understood that significant variations in spring design parameters outside those presented in Table 1 may be utilized in particular designs in accordance with the invention.

TABLE 1

| Spring Design | | | |
|---|---|---|---|
| Parameter | Minimum | Preferred | Maximum |
| Mean spring bend radius | | 2.125 inches | |

TABLE 1-continued

| Spring Design | | | |
|---|---|---|---|
| Parameter | Minimum | Preferred | Maximum |
| Outer coil diameter | | 1.623 inches | |
| Outer coil wire diameter | 0.144 inches axial<br>0.146 inches radial | | 0.146 inches axial<br>0.152 inches radial |
| Inner coil wire diameter | 0.130 inches axial<br>0.135 inches radial | | 0.135 inches axial<br>0.140 inches radial |
| Wire profile corner fillet | | 3.030 inches | |
| Outer coil ID/OD curvature | 0.216 inches | | 0.219 inches |
| Inner coil ID/OD curvature | 0.195 inches | | 0.203 inches |

As shown in Table 1, in one embodiment, the mean spring bend radius of the flexible shaft 10 should be in the order of 2.125 inches, the outer coil diameter is preferably 1.623 inches, and the winding pitch should be just adequate to close the coils on the inside of the bend during tool assembly (pitch is generally a design parameter that is function of other parameters such as spring cross-sectional shape, spring diameter and bend radius). It is also preferred that the cross sectional profile of the coil spring wire be generally rectangular, having somewhat flattened surfaces on the two opposite faces and curved surfaces on the pair of opposite sides. As shown in FIGS. 4 and 5, it is preferred that a 0.030 inch fillet be present on all corners. Such a custom wire profile will increase rigidity without an appreciable increase in bending stress, and will decrease the contact stress between concentrically adjacent springs 11 *a*, 11 *b* within the shaft 10. The flat surfaces of the spring profile provide a distributed point of contact between the outer surfaces of the spring 11 as well as against the roller bearings 33 of the deflection assembly 30, as described below.

Preferably, design tolerances between the inner and outer springs will be such that the inner spring will slide within the outer spring. Typically, the OD of the inner spring will have tolerances of design value −0.01" whereas the ID of the outer spring will be design value +0.01".

Deflection Assembly

The design of the deflection assembly 30 is important to the overall performance of the lateral drilling tool as the rotary and axial friction of the flexible shaft 10 during deflection will significantly influence the net bit torque and the net weight that can be applied to the bit 20. Moreover, the internal shape of the deflection assembly 30 is an important determinant of the cyclical stress to which the flexible shaft 10 is subjected to during rotation.

Figure 6A:
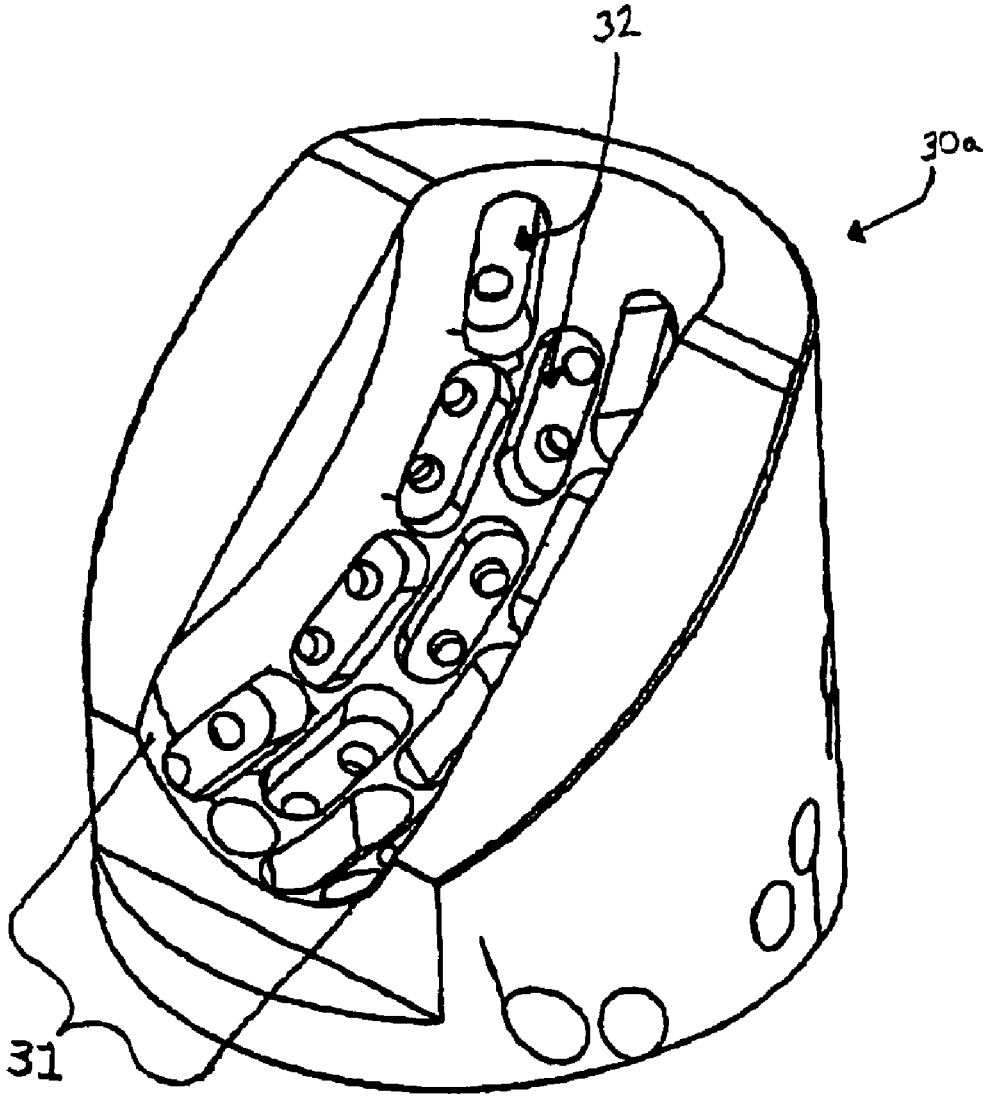
FIGS. 6*a* and 6*b* are perspective views of lower and upper portions of a deflection assembly in accordance with an embodiment of the invention.
Figure 6B:
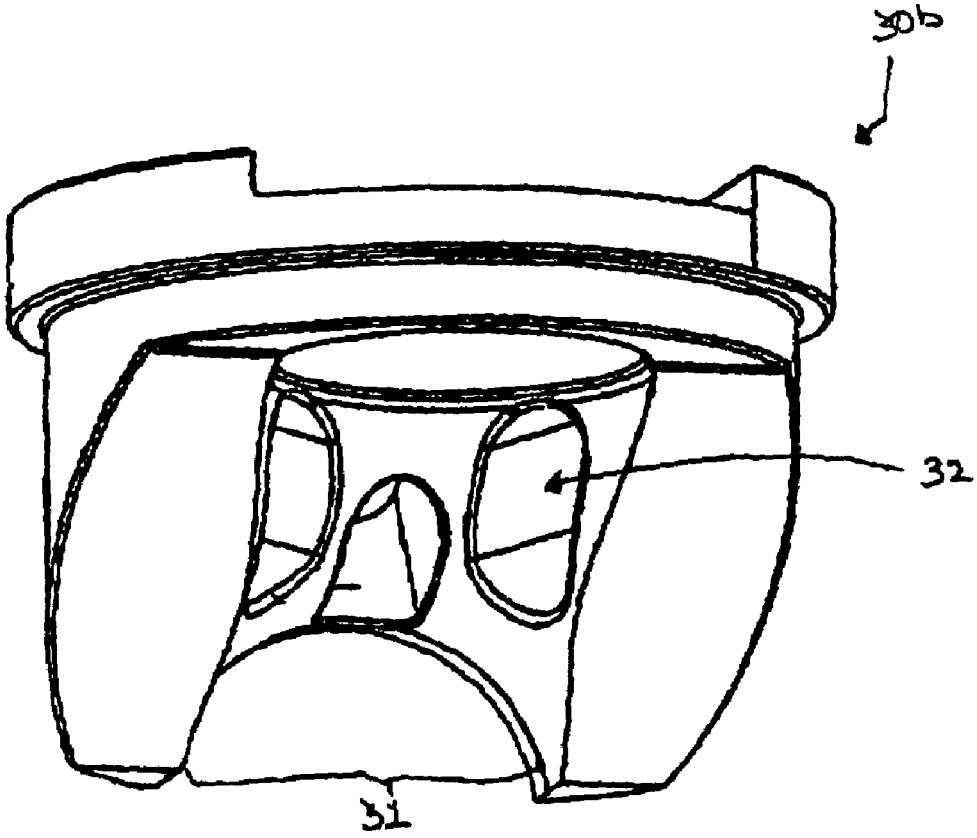

FIGS. 6*a* and *b*, show an embodiment of the deflection assembly 30, including lower and upper portions 30*a*, 3*b*, respectively. The assembly, when mounted within the housing 40, has a generally elbow-shaped channel 31 for receiving and deflecting the shaft 10. The diameter of the channel 31 should be only slightly larger than the outer diameter of the outermost coil spring 11*a* of the flexible shaft 10 so as to closely guide the direction of bit 20 deflection.

The deflection assembly 30 includes recesses 32 for receiving multiple guide rollers 33 (see FIGS. 7*a* and 7*b*), that are arranged so as to provide rolling surfaces 34 with axes of rotation parallel to the longitudinal axis of the rotating shaft. When a plurality of guide rollers 33 are arranged within the deflection assembly 30 as shown in FIGS. 8*a* and 8*b*, the guide rollers 33 will support rotation of the coil springs 11 within the flexible shaft 10, supporting the advancement of the flexible shaft 10 within the deflection assembly 30. Experimental results indicate that inclusion of rollers within the deflection assembly 30 substantially reduces the axial and rotational friction of the shaft 10, reducing the stress on the coil springs 11.

Figure 7A:
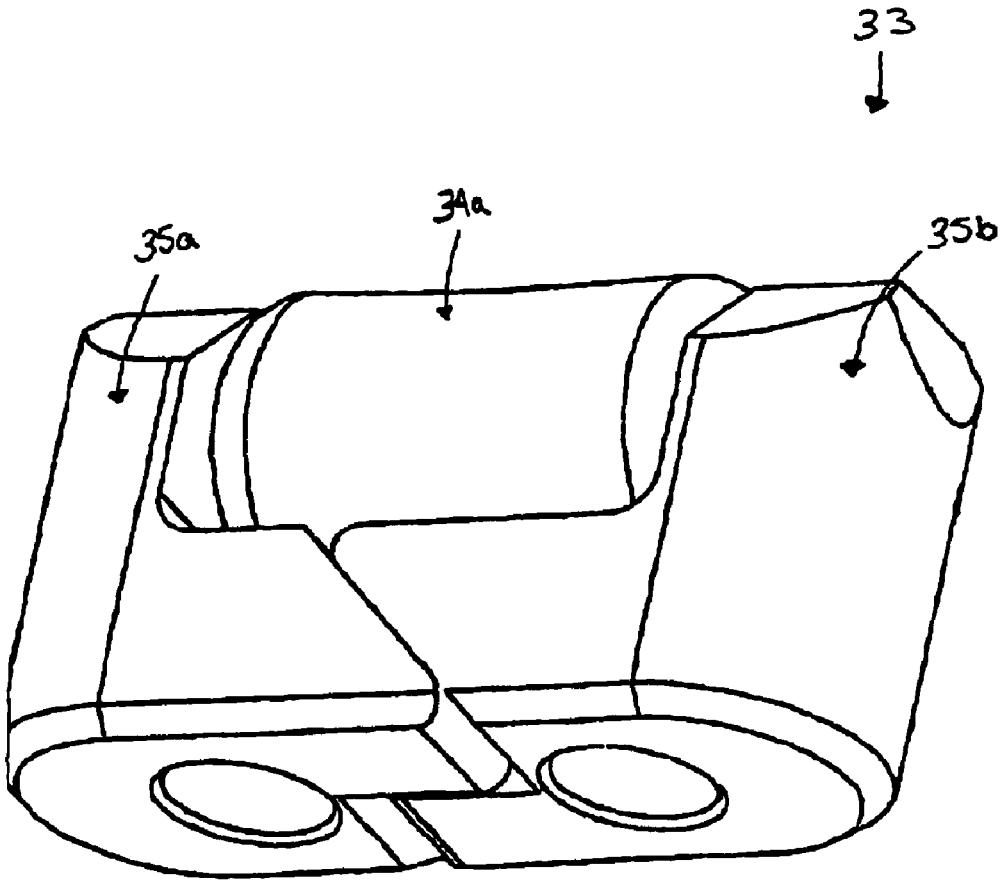
FIGS. 7*a* and 7*b* are perspective views of roller bearing supports in accordance with one embodiment of the invention; and, FIGS. 8*a* and 8*b* are perspective views of lower and upper portions of a deflection assembly with roller bearings attached, in accordance with one embodiment of the invention.
Figure 7B:
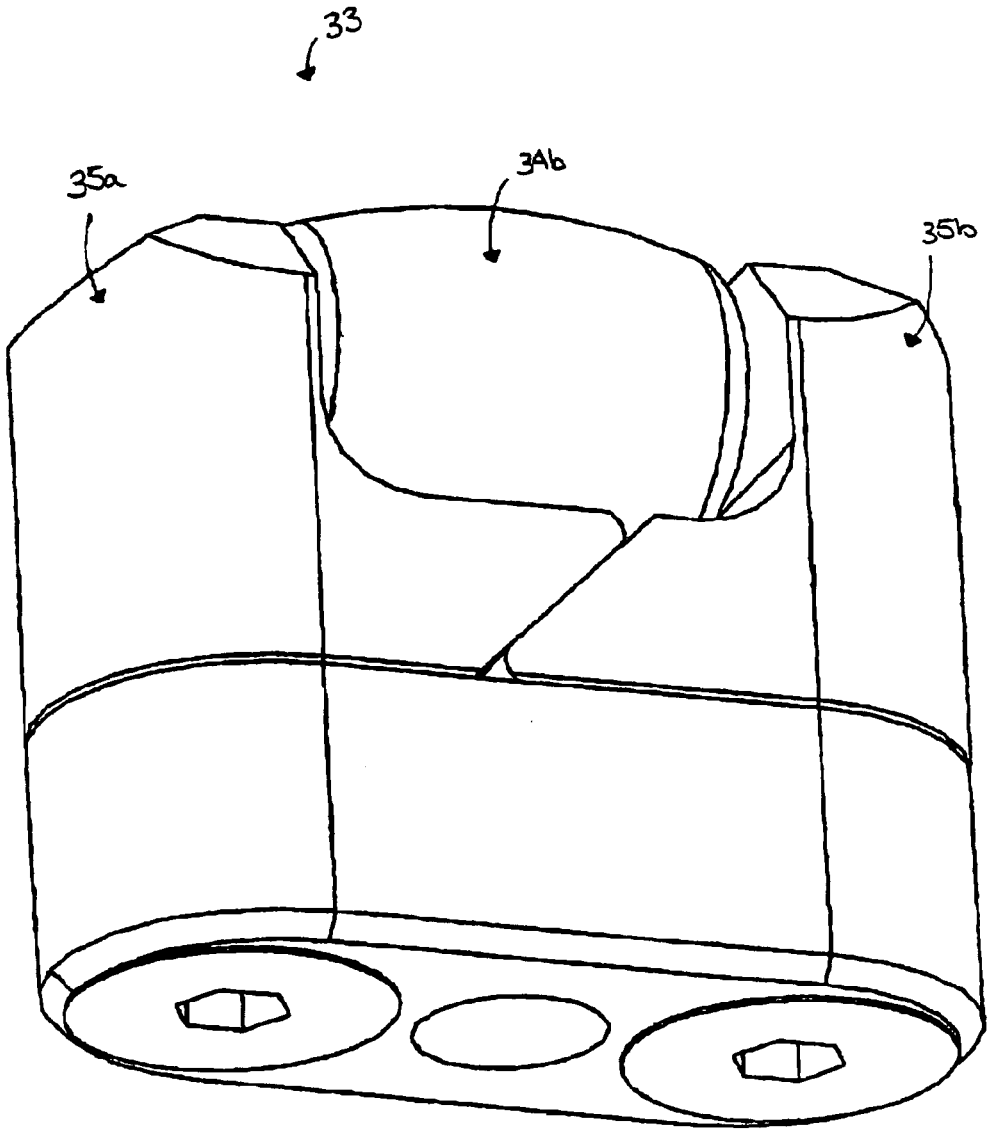
Figure 8A:
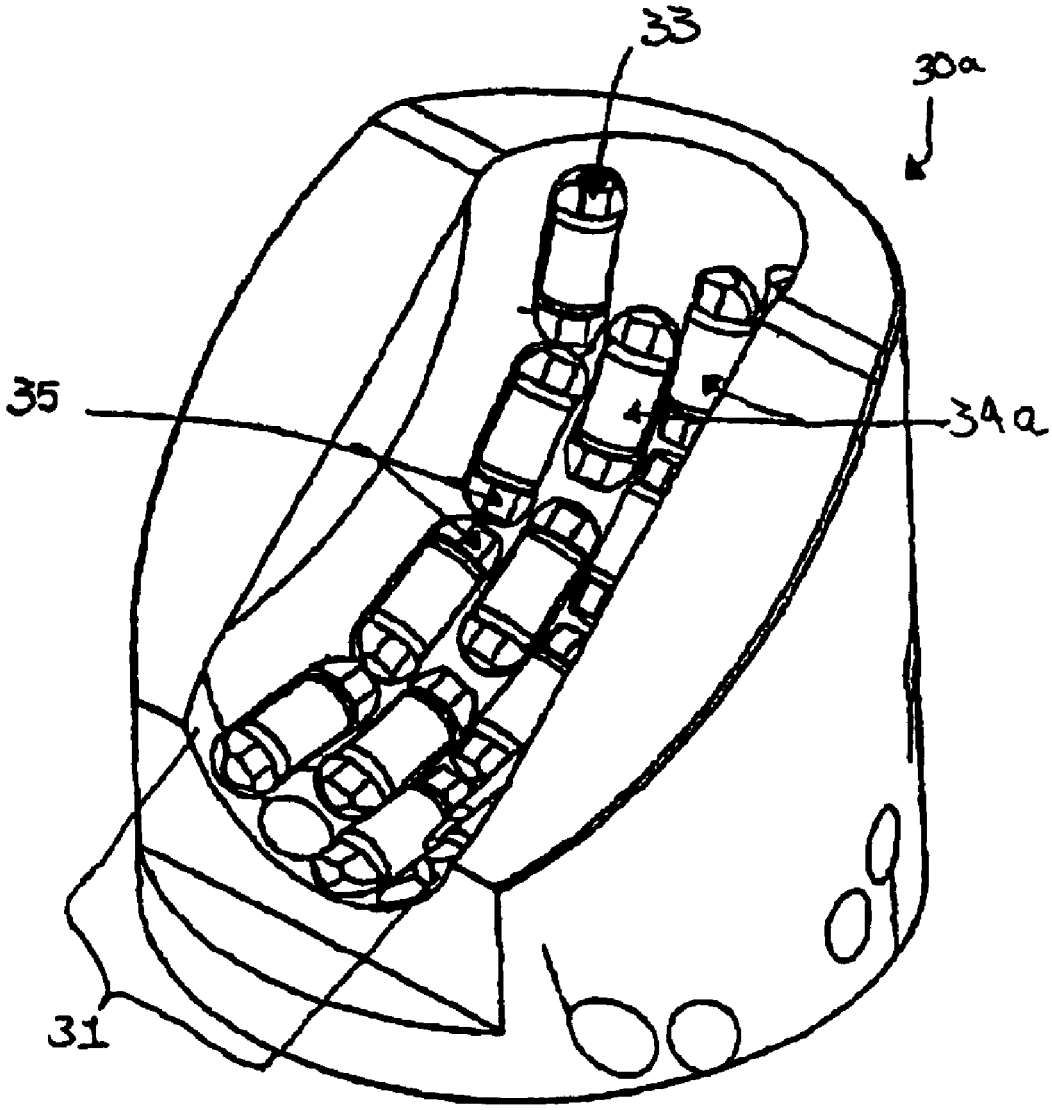
Figure 8B:
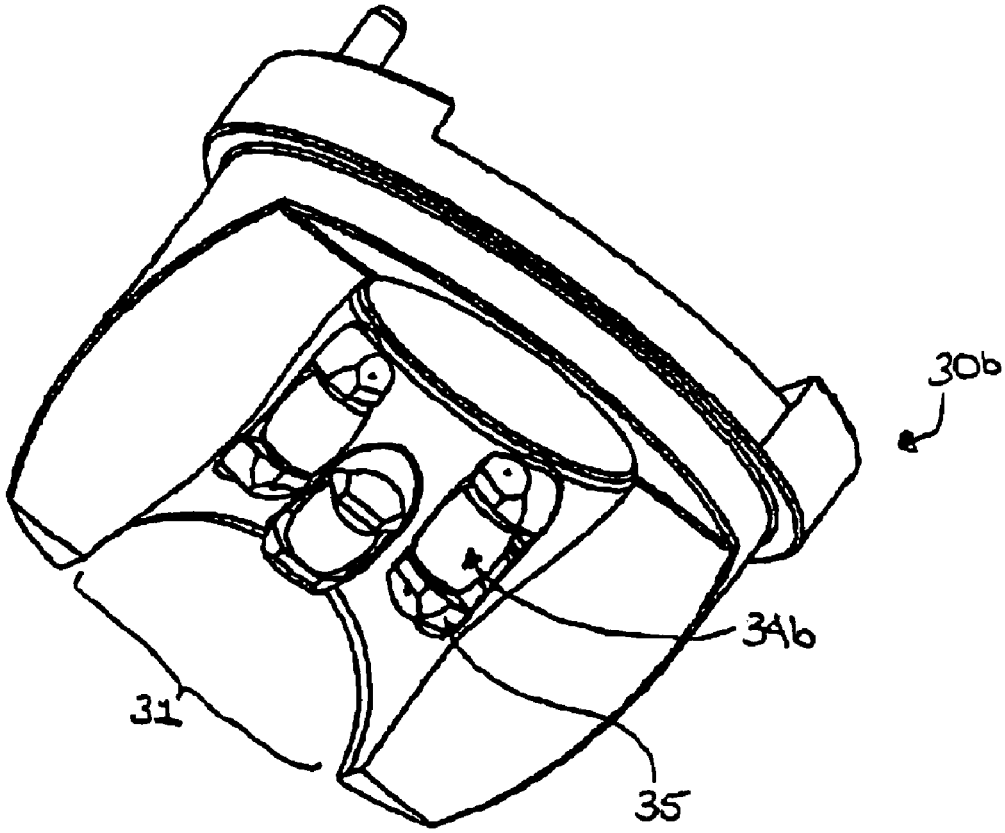

The guide rollers 33, as shown in FIGS. 7*a* and 7*b*, each include a generally cylindrical roller surface 34 that is preferably curved to match the contour of the flexible shaft 10. Therefore, depending on the position of a given roller within the deflection assembly 30, the roller surface 34 may be concave (as shown at 34*a* in FIG. 7*a*) or convex (as shown at 34*b* in FIG. 7*b*) to provide the necessary deflection support required at that position. Generally, guide rollers 33 having concave roller surface 34*a* are mounted within the lower portion 30*a* of the deflection assembly, and guide rollers 33 having a convex roller surface 34*b* are mounted within the lower portion 30*b* of the deflection assembly. The guide rollers 33 are matingly engaged within the deflection assembly 30 to ensure accurate positioning relative to other guide rollers 33, and relative to the housing window through which the bit 20 and flexible shaft 10 emerge from the tool. In the embodiment shown in FIG. 6*a*, each roller is attached to two engageable split roller mounts 35 which are fastened together by cap screws. In one embodiment, the rollers 34 may be adjusted on the roller mounts 35.

Assembly

During assembly the guide rollers 33 are secured within the appropriate portions of the deflection assemblies 30*a*, 30*b*, and deflection assembly and associated components are secured within the housing 40. The flexible tubing is inserted within the channel 31 and through the deflection assembly 30 to protrude from the drilling aperture 41 in the housing 40. As the flexible tubing is advanced into the tool, the guide rollers 33 support the advancement of the tubing through the deflection assembly 30. Once the tubing is inserted, the leading end of the tubing is anchored to the drill bit 20, which is then secured to the housing 40.

Operation of the Tool

When it is desired to drill a lateral drainhole within a wellbore, the tool is attached to a tubing string and lowered downhole to a desired depth where it is anchored within the well. The flexible shaft 10 is rotated and advanced by operation of the motor and known drill systems. Within the deflection assembly, the guide rollers facilitate the rotation of the shaft 10. The rollers will also act to distribute the rotation and downward forces about the circumference and length of the deflected portion of the shaft 10 with the result that the shaft 10 will gradually and evenly stiffen over its length until it is sufficiently strong to support driving of the drill bit 20 through the well casing and formation to create the desired drainhole.

The alternating orientation of the coiled springs 11*a*, 11*b* within the shaft 10 therefore provides the flexibility required during assembly of the tool, while also providing sufficient stiffening to provide an evenly distributed strength to the shaft 10 during drilling. The rollers within the deflection assembly 30 allow the coiled springs 11 to remain freely rotatable during deflection, and further assist in transmitting torque to the stiffened shaft 10 and drill bit 20 during drilling.

The profile of the spring 11 relieves the stress on the coil springs by increasing rigidity during drilling without increasing the bending stress during prolonged deflection within the tool.

EXAMPLES

A number of tests were performed to evaluate the performance of the assembled tool with the spring design with and without the roller bearing system. Successful tests were achieved with a variety of different spring designs producing lateral drainholes upto 48 inches long into the formation both with and without the roller bearing system (a solid elbow trough system). Superior results were achieved when drilling into a simulated open hole formation (ie without a steel casing). A variety of bit weights were examined with the best results being obtained with approximately 50 lbs of weight on the bit into an open hole.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed is:

1. A lateral drainhole drilling tool for deflecting a flexible shaft through an angle of deflection to enable downhole lateral drilling for the recovery of hydrocarbons, the tool comprising a deflection assembly and a drilling shaft having two counter-coiled springs operatively supported within the deflection assembly, each spring comprised of metal wire having a rectangular cross sectional profile wherein the flexible shaft is capable of supporting a torsional and compressive downhole load to enable lateral drilling when the flexible shaft is deflected within the deflection assembly wherein the ratio of the radial and axial dimensions of each spring is 1:1 and the spring has convex surfaces in the radial dimension and flat surfaces in the axial dimension.

2. The drilling tool of claim 1 wherein the angle of deflection is between 45 and 90 degrees.

3. The drilling tool of claim 1 wherein the deflection assembly includes a plurality of guide rollers.

4. The drilling tool of claim 3 wherein the guide rollers include rolling surfaces parallel to the longitudinal axis of the drilling tool.

5. The drilling tool of claim 4 wherein each rolling surface is contoured to deflect the flexible shaft through the angle of deflection.

6. The drilling tool of claim 3 each guide roller includes a rolling surface mounted upon a roller mount.

7. The drilling tool of claim 3 wherein each roller mount comprises two split roller mounts.

8. The drilling tool of claim 7 wherein each rolling surface is adjustable upon each roller mount.

9. The drilling tool of claim 3 wherein at least one guide roller has a concave surface.

10. The drilling tool of claim 3 wherein at least one guide roller has a convex surface.

11. The drilling tool of claim 1 wherein each guide roller is retained within a recess within the deflection assembly.

12. The drilling tool of claim 1 wherein the two counter-coiled wire springs are telescopically and slidingly engaged with respect to each other and wherein the tolerance between the outer diameter of the inner spring and the inner diameter of the outer spring is 0.0 to 0.01".

13. The drilling tool of claim 12 wherein the metal wire has corners each having a fillet.

14. The drilling tool of claim 13 wherein the fillet is dimensioned to increase the contact area between adjacent spring surfaces when bent.

15. The drilling tool of claim 1 wherein the counter-coiled springs support a compressive downhole load of 50 pounds when deflected.

* * * * *